US006463308B1

(12) United States Patent
Wikborg et al.

(10) Patent No.: US 6,463,308 B1
(45) **Date of Patent: *Oct. 8, 2002**

(54) TUNABLE HIGH $T_C$ SUPERCONDUCTIVE MICROWAVE DEVICES

(75) Inventors: Erland Wikborg, Danderyd (SE); Orest Vendik, S. Petersburg (RU); Erik Kollberg, Lindome (SE); Spartak Gevorgian, Göteborg (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/989,166

(22) Filed: Dec. 11, 1997

Related U.S. Application Data

(63) Continuation of application No. PCT/SE96/00768, filed on Jun. 13, 1996.

(30) Foreign Application Priority Data

Jun. 13, 1995 (SE) ..... 9502137

(51) Int. Cl.[7] ..... H01P 7/08; H01P 1/203; H01B 12/02

(52) U.S. Cl. ..... 505/210; 333/219; 333/202; 333/99.005

(58) Field of Search ..... 333/995, 219, 333/202, 205, 204; 505/210, 700, 701, 866

(56) References Cited

U.S. PATENT DOCUMENTS

| | | | | |
|---|---|---|---|---|
| 4,918,050 | * | 4/1990 | Dworsky | 333/995 |
| 5,132,282 | * | 7/1992 | Newman et al. | 505/701 |
| 5,179,074 | | 1/1993 | Fiedziuszko et al. | 333/995 |
| 5,208,213 | * | 5/1993 | Ruby | 505/701 |
| 5,219,827 | * | 6/1993 | Higaki et al. | 333/995 |
| 5,391,543 | * | 3/1995 | Higaki et al. | 333/995 |
| 5,397,769 | * | 3/1995 | Higaki et al. | 333/995 |
| 5,538,941 | * | 7/1996 | Findikoglu et al. | 333/995 |
| 5,786,303 | * | 7/1998 | Mansour | 333/995 |

FOREIGN PATENT DOCUMENTS

| | | | | |
|---|---|---|---|---|
| EP | 496 512 | | 7/1992 | |
| JP | 17701 | * | 1/1990 | 333/204 |
| WO | WO94/13028 | | 6/1994 | |
| WO | WO94/28592 | | 12/1994 | |
| WO | WO96/42117 | | 12/1996 | |
| WO | WO87/00350 | | 12/1997 | |

OTHER PUBLICATIONS

Jackson C.M. et al; "Novel Monolithic Phase Shifter Combining Feroelectrics and High Temperature Superconductors"; *Microwave and Optical Tech Letters*; vol. 5, No. 14; Dec. 1992, pp. 722–726.*

(List continued on next page.)

*Primary Examiner*—Benny T. Lee
(74) *Attorney, Agent, or Firm*—Burns, Doane, Swecker & Mathis, L.L.P.

(57) ABSTRACT

A tunable microwave device has a substrate of a dielectric material which has a variable dielectric constant. At least one superconducting film is arranged on at least parts of the dielectric substrate. The dielectric substrate includes a non-linear dielectric bulk material.

28 Claims, 9 Drawing Sheets

OTHER PUBLICATIONS

Galt, D. et al., "Characterization of a Tunable Thin Film Microwave YBCO–x/STO Coplanar Capacitor", American Institute of Physics, vol. 63, No. 22, pp. 3078–3080, Nov. 1993.

Vendik, O.G. et al., "1 GHz Tunable Resonator on Bulk Single Crystal SrTiO3 Plated with YBa2Cu3o7–x Films", Electronics Letters, vol. 31, No. 8, Apr. 1995.

Abbas, F. et al., "Tunable Mcrowave Components Based on Dielectric Non Linearity by Using HTS–Ferrelectric Thin Films", IEEE Transactions on Applied Superconductivity, vol. 5, No. 4, pp. 3511–3517, Dec. 1995.

Findikoglu, A.T. et al., "Electrical Characteristics of Coplanar Waveguide Devices Incorporating Nonlinear Dielectric Thin Films of SrTiO3 and Sr05Ba05TiO3," Microwave and Optical Technology Letters, vol. 9, No. 6, pp. 306–310, Aug. 1995.

Shen, Z–Y, High Temperature Superconducting Microwave Circuits, Artech House, 1994.

Sheen, D.M. et al., "Current Distribution, Resistance and Inductance for Superconducting Strip Transmission Lines", IEEE Transactions on Applied Superconductivity, vol. 1, No. 2, Jun. 1991.

Krupka, et al., "Dielectric Properties of Single Cystals of $Al_2O_3$, $LaAlO_3$, $NdGaO_3$, $SrTiO_3$, and MgO at Cryogenic Temperatures", IEEE MTT, vol. 42, No. 10, p. 1886, 1994.

Jackson, C.M. et al., "A High Temperature Superconducting Phase Shifter", Microwave Journal, vol. 5, No. 4, pp. 72–78, Dec. 1992.

* cited by examiner

TUNABLE HIGH $T_C$ SUPERCONDUCTIVE MICROWAVE DEVICES

This application is a continuation of International Application No. PCT/SE96/00768, filed Jun. 13, 1996, which designates the United States.

BACKGROUND

The present invention relates to microwave devices and components comprising dielectric substrates and conductors in the form of superconducting films. The tunability of such devices is obtained through varying the dielectric constant of the dielectric material. Examples of devices are for example tunable resonators, tunable filters, tunable cavities etc. Microwave devices or components are important for example within microwave communication, radar systems and cellular communication systems. Of course there are also a number of other fields of application.

The use of microwave devices is known in the art. In "High Temperature Superconducting microwave circuits" by Z-Y Shen, Artech House 1994, dielectric resonators are discussed which are based on $TE_{011}$ delta modes. A dielectric resonator is clamped between thin High Temperature Superconducting films (HTS) which are deposited on separate substrates and thus not directly on the dielectric. These resonators fulfill the requirements as to cellular communication losses and power handlings at about 1–2 GHz. It is however inconvenient that the dimensions of the HTS films and the dielectric substrates at these frequencies (e.g. 1–2 GHz) are large and moreover the devices are expensive to fabricate. Furthermore they can only be mechanically tuned which in turn makes the devices (e.g. filters) bulky and introduce complex problems in connection with vibrations or microphonics. WO 94/13028 shows integrated devices of ferroelectric and HTS films. Thin epitaxial ferroelectric films are used. Such films have a comparatively small dielectric constant and the tuning range is also limited and the microwave losses are high. Furthermore there is a highly non-linear current density in thin HTS film coplanar waveguides and microstrips. This results from the high current density at the edges of the strips, D. M. Sheen et al, IEEE Trans. on Appl. Superc. 1991, Vol. 1, No. 2, pp. 108–115. The applicability of these integrated HTS/ferroelectric thin film devices is therefore limited and they are not suitable as for example low-loss narrow-band tunable filters.

Generally tunable filters are important components within microwave communication and radar systems as discussed above. Filters for cellular communication systems for example, which may operate at about 1–2 GHz occupy a considerable part of the volume of the base stations, and often they even constitute the largest part of a base station. The filters are furthermore responsible for a high power consumption and considerable losses in a base station. Therefore tunable low loss filters having high power handling capabilities are highly desirable. They are also very attractive for future broad band cellular systems. Today mechanically tuned filters are used. They have dielectrically loaded volume resonators having dielectric constants of about 30–40. Even if these devices could be improved if materials were found having still higher dielectric constants and lower losses, they would still be too large, too slow and involve losses that are too high. For future high speed cellular communication systems they would still leave a lot to be desired.

In U.S. Pat. No. 5,179,074 waveguide cavities wherein either part of or all of the cavity is made of superconducting material are shown. Volume cavities with dielectric resonators have high Q-values (quality factor) and they also have high power handling capabilities. They are widely used in for example base stations of mobile communications systems. The cavities as disclosed in the above mentioned US patent have been reduced in size and moreover the losses have been reduced. However, they are mechanically tuned and the size and the losses are still too high. WO 94/13028 also shows a number of tunable microwave devices incorporating high temperature superconducting films. However, also in this case thin ferroelectric films are used as already discussed above, and the size is not as small as needed and the losses are too high. Furthermore, the tuning range is limited.

"1 GHz tunable resonator on bulk single crystal SrTiO plated with YBaCuO films." by O. G. Vendik et al, Electronics Letters, Vol. 31, No. 8, April 1995 shows a tunable resonator on bulk single crystal SrTiO3 plated with YBCO films. This device however suffers from the drawbacks of not being usable above $T_c$ (the critical temperature for superconductivity). This means for example that no signals could pass if the temperature would be above $T_c$ which may have serious consequences in some cases. These devices cannot be used unless in a superconducting state.

Furthermore the superconducting films are very sensitive and since they are in no way protected this could have serious consequences as well. In general, in the technical field, only dielectrics e.g. photoresist have been used to protect superconducting films.

SUMMARY OF THE INVENTION

Thus tunable microwave devices are needed which can be kept small, operate at high speed and which do not involve high losses. Devices are also needed which can be tuned over a wide range and which do not require mechanical tuning. Devices are needed which have a high dielectric constant particularly at cryogenic temperatures and particularly devices are needed which fulfil the abovementioned needs in the frequency band of 1–2 GHz, but of course also in other frequency bands. Still further devices are needed which can operate in superconducting as well as in non-superconducting states. Devices are also needed wherein the superconducting films are less exposed. Particularly devices are needed which can be electrically tuned and reduced in size at a high level of microwave power.

Therefore a device is provided which comprises a substrate of a dielectric material with a variable dielectric constant. At least one superconducting film is arranged on parts of the dielectric substrate which comprises a non-linear dielectric bulk material. The substrate comprises a single crystal bulk material and the superconducting film or films comprise high temperature superconducting films. A normal conducting layer is arranged on one or both sides of the superconducting film(s) which is/are opposite to the dielectric substrate. The tuning is provided through producing a change in the dielectric constant of the dielectric material and this may particularly be carried out via external means and particularly the electrical dependence of the dielectric constant used for example for voltage control or also the temperature dependence of the dielectric constant can be used for controlling purposes. Particularly, an external DC bias voltage can be applied to the superconducting film. Alternatively a current can be fed to the films but it is also possible to use a heating arrangement connected to the superconducting film or films and in this way change the electric constant of the dielectric material. Bulk single crystal dielectrics particularly bulk ferroelectric crystals, have a high dielectric constant which can be above for example 2000 at temperatures below 100° K, in the case of high temperature superconducting films below $T_c$, which is the transition temperature below which the material is superconducting. Krupka et al in IEEE MTT, 1994, Vol. 42, No. 10, p. 1886 states that bulk single crystal ferroelectrics such as SrTiO3 have small dielectric losses such as 2.6× 10–4 at 77° K and 2 GHz and very high dielectric constants at cryogenic temperatures.

However, according to WO 94/13028 and "A High Temperature Superconducting Phase Shifter" by C. M. Jacobson et. al in Microwave Journal Vol. 5, No. 4, December 1992 pp 72–78 states that the electrical variation to change the dielectric constant of bulk material is small and thus far from satisfactory. Moreover, microwave integrated circuit devices are exclusively made by thin film dielectrics which according to the known documents is necessary.

The dimensions of the devices according to the invention can be very small, such as for example smaller than one centimeter at frequencies of about 1–2 GHz and still the total losses are low. This however merely relates to examples and the invention is of course not limited thereto.

Particularly the superconducting film arrangement and the dielectric substrate are arranged so that a resonator is formed and the superconducting film(s) may be arranged on at least two surfaces of the dielectric substrate. According to different embodiments the superconducting films may be arranged directly on the dielectric substrate or a thin buffer layer may be arranged between the superconducting films and the dielectric substrate. One aspect of the invention relates to the form of the parallel plate resonator wherein the dielectric substrate may comprise a resonator disc. More particularly at least one superconducting film (and normal conducting film arranged thereon) may have an area which is smaller, e.g., particularly somewhat smaller, than the corresponding area of the dielectric substrate on which it is arranged in order to provide coupling between degenerate modes thus providing a dual mode operation resonator. Even more particularly, in one aspect of the invention, it provides a two-pole tunable passband filter (or a multi-pole tunable filter). Means may be provided for controlling the coupling between the two or more degenerate modes.

According to still another aspect of the invention it is aimed at providing a tunable cavity. One or more resonators are then enclosed in a cavity comprising superconducting material or non-superconducting material. In the case of non-superconducting material, it may particularly be covered on the inside with a thin superconducting film. The cavity, still more particularly, comprises a below cut-off frequency waveguide. The device comprises coupling means for coupling micro-wave signals in and out of the device. These can be of different kinds as will be further described in the detailed description of the invention.

Moreover, in a particular embodiment of the invention second tuning means may be provided for fine-tuning or calibrating of the resonance frequency of the dielectric substrate of the resonator. These means may comprise a mechanically adjustable arrangement and can for example also comprise thermal adjusting means etc.

In a particular embodiment a cavity as referred to above may comprise two or more separate cavities each comprising at least one resonator. These resonators are connected to each other via interconnecting means and form a dual mode or a multi-mode resonator.

One example on a dielectric substrate is a material comprising $SrTiO_3$ and the superconducting films may be so called YBCO-films (YBaCuO). The invention is applicable to a number of different devices such as tunable microwave resonators, filters, cavities etc. Particular embodiments relate to tunable passband filters, two three- or four-pole tunable filters etc. Other devices are phase shifters, delay lines, oscillators, antennas, matching networks, etc.

Tunable microwave integrated circuits are described in the copending patent application "Arrangement and method relating to tunable devices" filed at the same time by the same applicant, published as WO 96/42117 and which is incorporated herein by reference.

BRIEF DESCRIPTION OF THE DRAWINGS

The invention will in the following be further described in a non-limiting way under reference to the accompanying drawings in which.

DETAILED DESCRIPTION

Figure 1A:
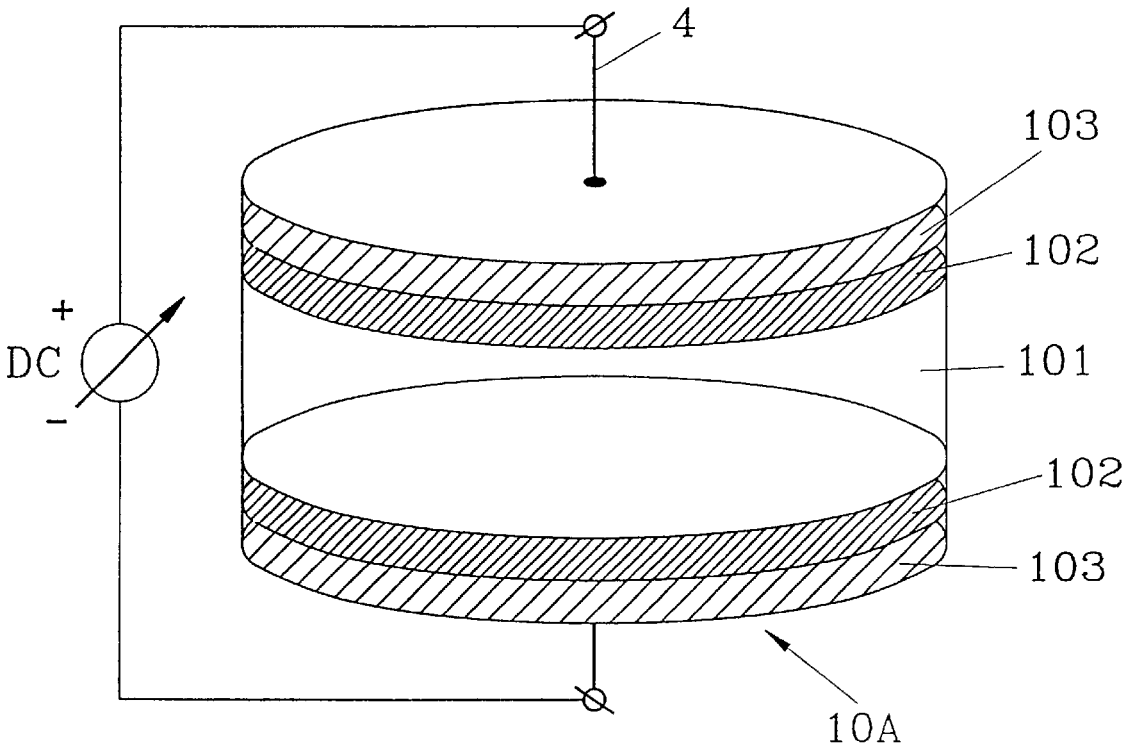
FIG. 1*a* illustrates an electrically tunable parallel plate resonator having a cylindrical form.
Figure 1B:
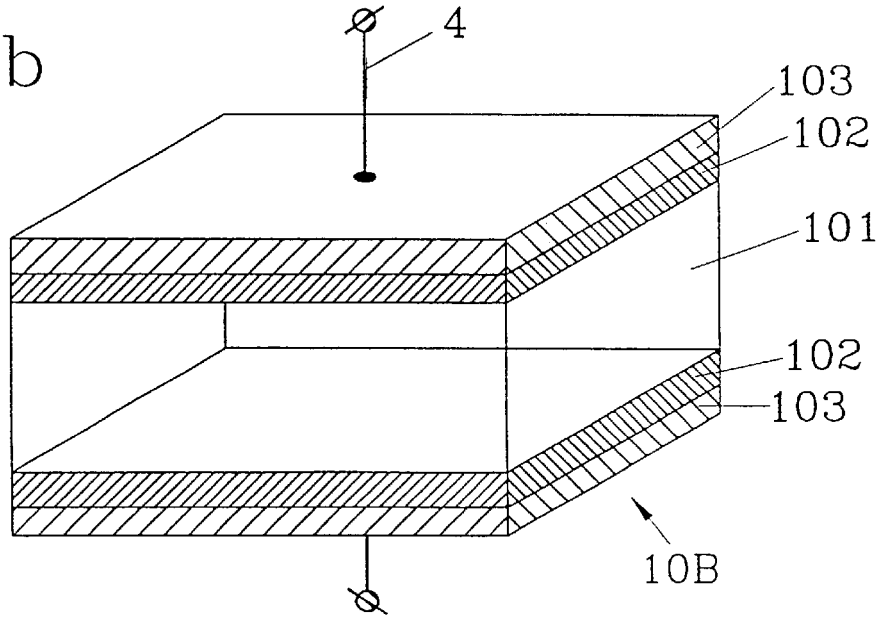
FIG. 1*b* illustrates an electrically tunable parallel plate resonator having a rectangular form.

FIG. 1*a* illustrates a first embodiment in which a nonlinear bulk dieletric substrate 101 with a high dielectric constant is covered by two superconducting films 102. The low loss nonlinear dielectric substrate 101 and the two superconducting films 102 (below their critical temperatures) comprise a microwave parallel plate resonator 10A with a high quality factor, Q-factor. Via a variable DC-voltage source a tuning voltage is applied. In an advantageous embodiment the superconducting films 102 comprise high temperature superconducting films HTS. These HTS films are covered by non-superconducting high-conductivity films or normally conducting films 103, such as for example gold, silver or similar conductors. These protective films 103 serve among others the purpose of providing a high Q-factor also above the critical temperature Tc and to serve as ohmic contacts for an applied DC tuning voltage. Moreover, these films serve the purpose of providing a long term chemical protection and protection in other aspects as well for the HTS films 102. A variable DC voltage source is provided for the application of a tuning voltage bias to the films. The voltage is supplied via a lead or conducting wires 4 and when a biasing voltage is applied, the dielectric constant of the nonlinear dielectric substrate 101 is changed. In this way a change in the resonant frequency (and the Q-factor) of the resonator is obtained. In FIG. 1*a,* a circular resonator 10A is illustrated. In FIG. 1*b,* a rectangular resonator 10B is illustrated with corresponding elements 101–103 as described above. These are the two simplest forms of resonators and for them the analysis of the performance is quite simple and the resonant frequencies can be predicted in a precise way. The rectangular and the circular shapes have different modes and modal field distributions and the application of these shapes in the area of microwave devices such as filters etc. is substantially given by the modal field distribution.

The dielectric substrate 101 for example comprises bulk single crystal strontium titanate oxide $SrTiO_3$. The superconducting films 102 may comprise thin superconducting films and the protective layer 103 may comprise a normal metal film as referred to above. The reference numeral 4 illustrates the leads for the DC biasing voltage current; this reference numeral remains the same throughout the drawings even if it can be arranged in different manners which however are known per se and need not be explicitly shown herein.

In the embodiments of FIGS. 1*a* and 1*b* an external DC bias voltage is supplied. It is however also possible to make use of a temperature dependence of the dielectric constant of the nonlinear dielectric bulk material instead of the voltage dependence. In illustrated embodiments the HTS films are deposited on the surfaces of a dielectric resonator disc of a cylindrical or a rectangular shape. However as referred to above, the shapes can be chosen in an arbitrary way and the thin films are deposited on at least two of the surfaces. Generally the low total loss of the device is due to the low dielectric loss of bulk single dielectric crystals, for example ferroelectric crystals and the low losses in the superconducting films, particularly high temperature superconducting films. In further embodiments which will be described later on in the detailed description one or more resonators are enclosed in a cavity, particularly a superconducting cavity and the losses are low also in the cavity walls (below $T_c$). In bulk single crystal dielectrics the nonlinear changes due to for example DC biasing (tunability) are larger than for example those in thin ferroelectric films as known from the state of the art. Furthermore tunability is improved through the deposition of the superconducting films which have a high work function for the charge carriers directly onto the surface of the dielectric or ferroelectric resonator. This prevents charge injection into the ferroelectrics and thus also the "electrete effect" along with freeze-out of the AC polarization at the boundary. As referred to above, in parallel plate resonators the HTS films are covered by non-superconducting films e.g. of normal metal. Through the use of these films 103 the devices are usable also above $T_c$ of the HTS-films. Otherwise the HTS-films (e.g. YBCO) would only act as poor conductors above $T_c$. Through the use of the films 103 however the devices still operate as resonators also above $T_c$. This means that the device operates both in a superconducting and in a non-superconducting state. Advantageously the thickness of the HTS-films each exceed the London penetration depth, which is the depth where current and magnetic fields can penetrate. In an advantageous embodiment the HTS-film thickness may be about 0.3 $\mu$m. This is of course merely given as an example and the invention is not limited thereto. If the superconducting film thickness exceeds the London penetration depth $\lambda_L$, the field of the superconductor does not reach or penetrate the normal conductor which would lead to increased microwave losses. When the temperature exceeds $T_c$, $\lambda_L$ does not exist. The normal conductor plates then act as resonator plates. If the temperature is below $T_c$, $\lambda_L$ is smaller than the thickness of the superconducting films.

The thickness of the normal metal plate, e.g. Au, Ag advantageously exceeds the skin depth. Furthermore, through the normal conductor plates good ohmic contact is provided when a DC-bias is applied. This reduces or prevents Joule heat generation which would have given degraded superconducting properties of the HTS-material. The normal conductors also serve as contacts for the voltage or current DC-bias and as protection layers. The normal metal may for example be Au or Ag or any other convenient metal. A further advantage of these protective films is that even in case of e.g. a failure in the cooling system used to maintain a sufficiently low temperature, the losses are kept at a low level and the device still operates.

In an advantageous embodiment, not illustrated in the figures, it is possible to arrange thin buffer layers between the superconducting films and the dielectric substrate, for example a ferroelectric substrate, in order to improve the quality of the superconducting films at the deposition stage and to stabilize the superconducting film-dielectric system by controlling the chemical reactions (e.g. exchange of oxygen) between the superconducting films and the dielectric substrate. Advantageously the thickness of the superconducting film is higher than the London penetration depth as referred to above. Furthermore the thickness of the protective layer 103 of normal metal constituting ohmic contacts is larger than the skin depth and gives reasonably high Q-factors even at temperatures above the critical temperatures $T_c$ of the superconducting film as discussed above. Although the non-superconducting films 103 are not explicitly illustrated in the embodiments relating to FIGS. 7*a,* 7*b,* 8*a,* 8*b,* 9, 10*a,* 10*b,* 10*c,* 11*a,* 11*b,* 12, they are advantageously provided also in these embodiments.

Figure 2:
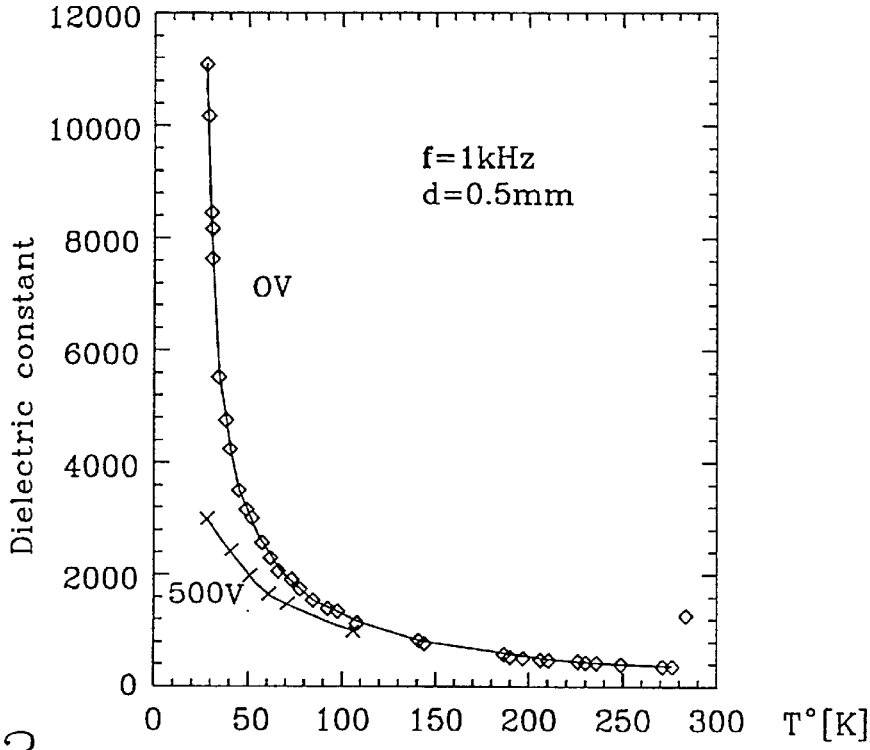
FIG. 2 shows an experimentally determined plot of the temperature dependence of the dielectric constant of the single crystal bulk material for two different voltages, FIG. 3 schematically illustrates the dependence of the dielectric constant of $SrTiO_3$ on applied DC tuning voltage for a number of different temperatures.
Figure 3:
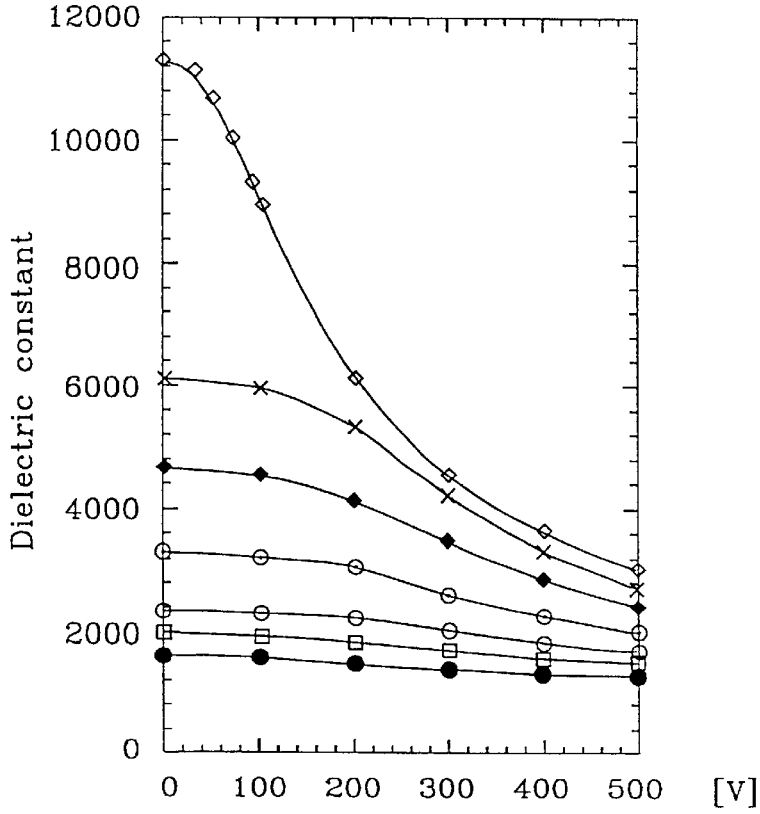
Figure 4:
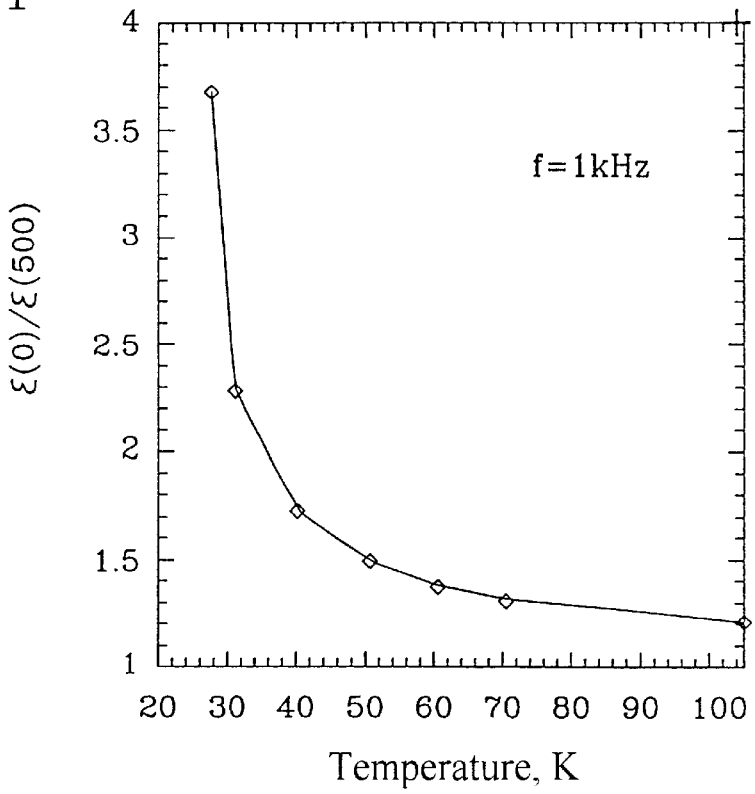
FIG. 4 illustrates how the ratio of dielectric constants for two different voltages varies with temperature.

FIG. 2 illustrates an experimentally determined temperature dependence of the dielectric constant of a single crystal bulk material, in this case SrTiO3 the frequency is here 1 kHz and the thickness of the bulk material is 0.5 mm. Two curves are illustrated, for 0 V and 500 V respectively. For the same resonator (for example the one illustrated in FIG. 1*a*) and with the same frequency and the same thickness as in FIG. 2, the variation in dielectric constant with the DC tuning voltage is illustrated for different temperatures in FIG. 3. In FIG. 4 the temperature dependence of the ratio of the dielectric constants at 0 V and 500 V for SrTiO3 is Illustrated for a frequency of 1 kHz.

Figure 5:
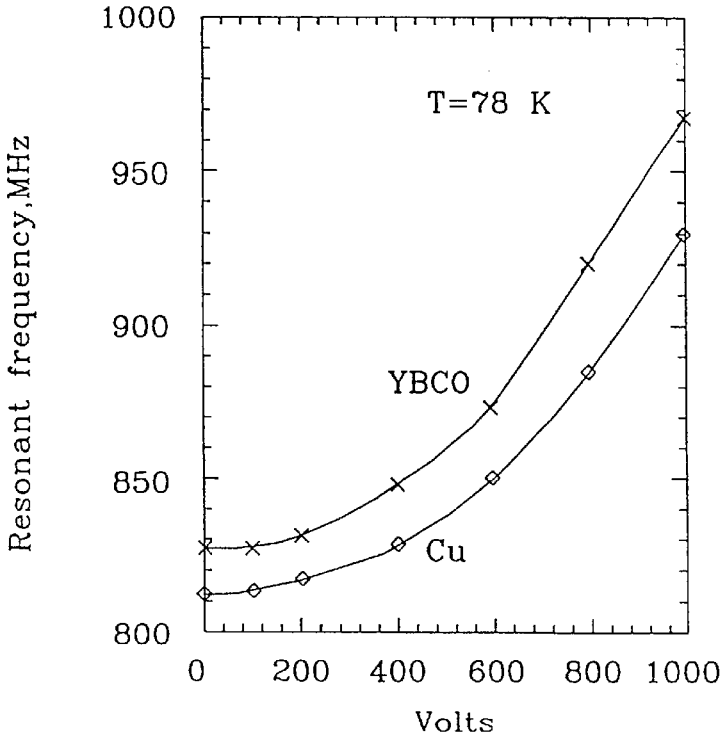
FIG. 5 illustrates how the resonant frequency depends on applied DC tuning voltage for the circular resonator of FIG. 1*a,* with YBCO and Cu electrodes.
Figure 6:
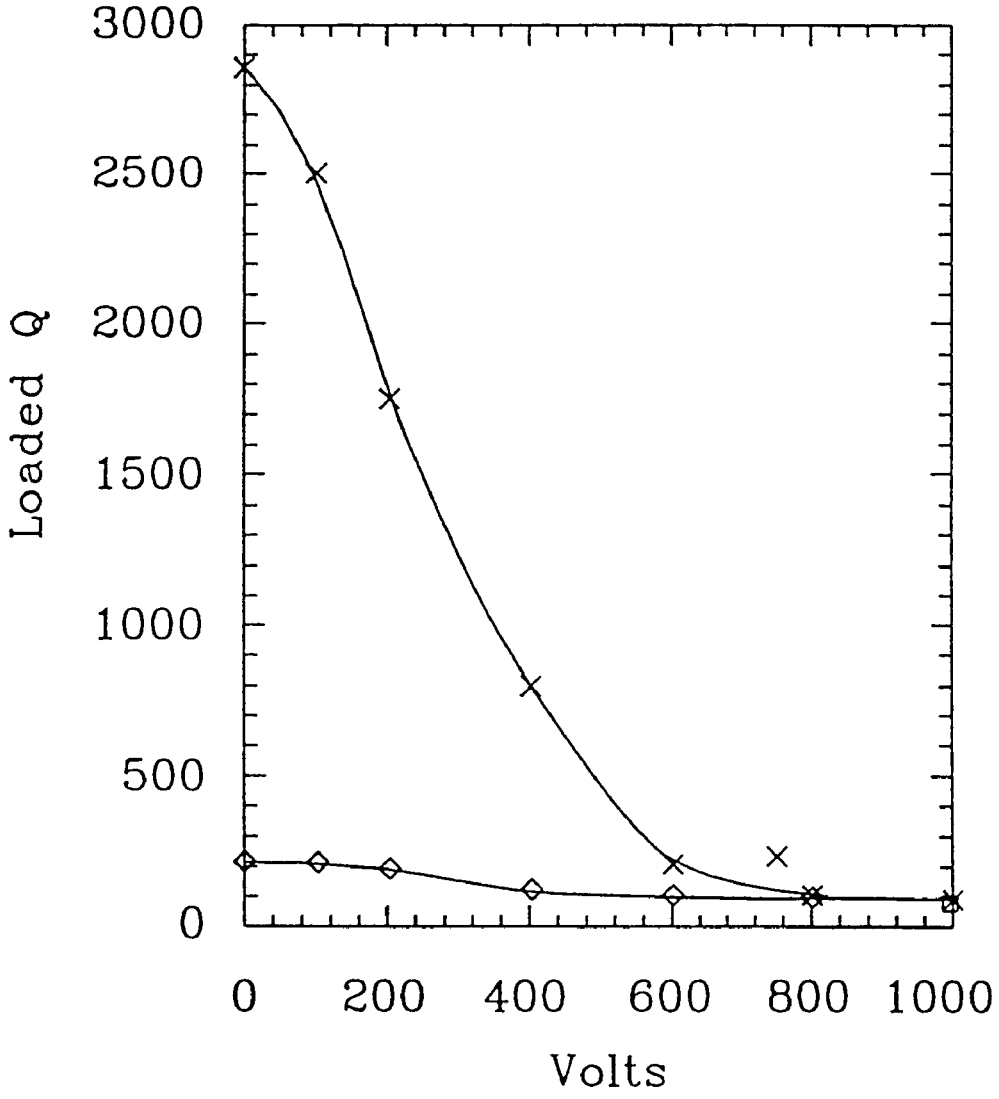
FIG. 6 illustrates the experimentally determined dependence of the loaded Q-factor of a circular resonator as illustrated in FIG. 5 on the applied DC tuning voltages.

FIGS. 5 and 6 illustrate experimentally determined dependencies of the resonant frequency and the loaded Q-factor respectively for a circular resonator as shown in FIG. 1*a* on the applied DC tuning voltage. The upper curves indicate the losses where only superconducting films are used and the lower curves indicate the losses where only Cu films (without superconductors) are used.

Figure 7A:
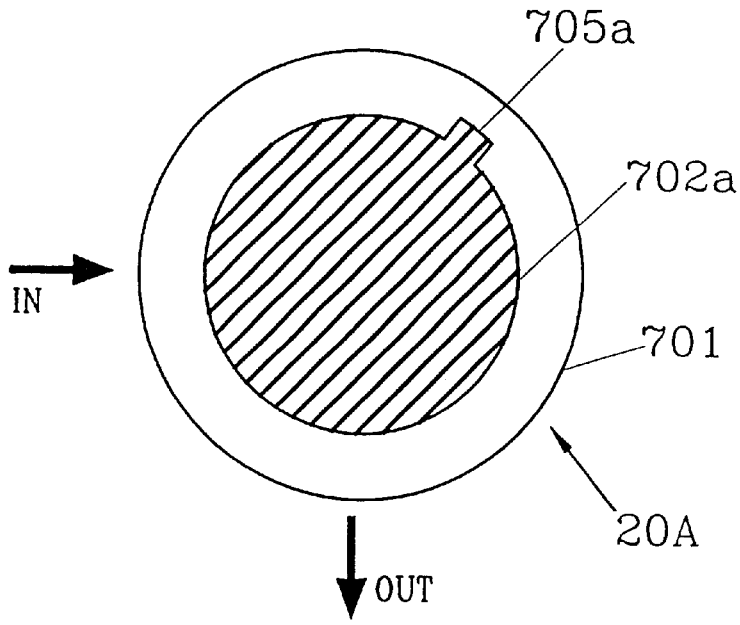
FIG. 7*a* illustrates a circular dual mode parallel plate bulk resonator.
Figure 7B:
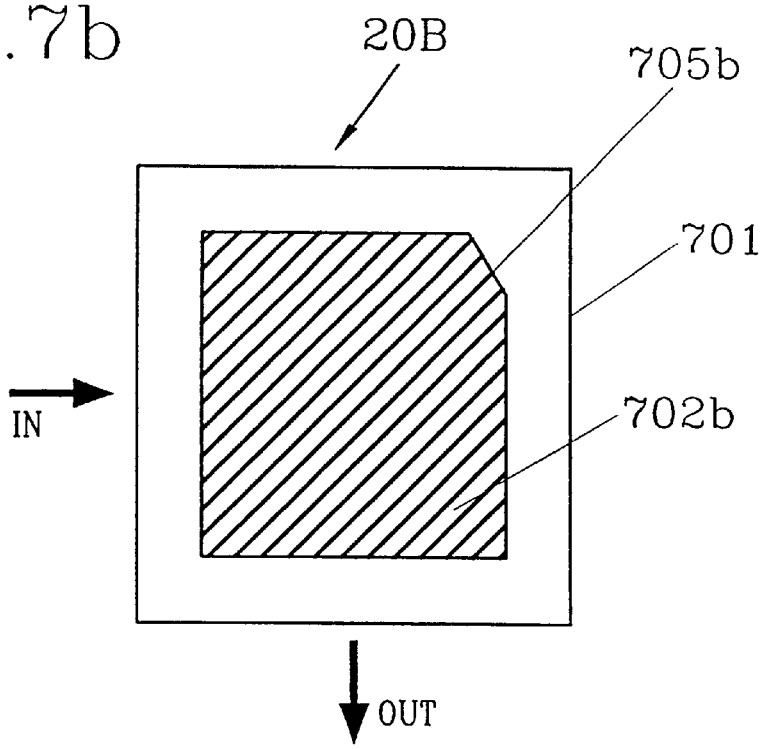
FIG. 7*b* illustrates a rectangular dual mode parallel plate bulk resonator.

FIGS. 7*a* and 7*b* illustrate two different embodiments of dual mode parallel plate bulk resonators 20A, 20B, respectively. At least one of the superconducting films 702*a,* 702*b* of each respective embodiment have smaller dimensions than the substrate of dielectric material 701. In FIG. 7*a* the resonator 20A is circular whereas in FIG. 7*b* the resonator 20B is rectangular. Since the dimensions of the superconducting films, particularly high temperature superconducting films, are reduced, the radiative losses are reduced. Since the superconducting films are smaller than the dielectric, dual mode operation of the bulk parallel plate dielectric resonator is enabled in that coupling between at least two degenerate modes is possible. The coupling between the two degenerate modes of the resonators 20A, 20B can be controlled via controlling means 705*a,* 705*b*. In FIG. 7*a* the controlling means comprises a protrusion 705*a* or a strip of superconducting film which gives a facility to control the coupling between the two or more degenerate modes. In FIG. 7*b* the coupling means is formed in that a piece 705*b* of the superconducting film is cutoff in one of the corners. IN and OUT refer to coupling in and coupling out respectively of microwaves. If the coupling means 705*a,* 705*b* are provided, two-pole tunable passband filters are obtained.

Advantageously non-superconducting layers are arranged on the superconducting films as discussed above under reference to the embodiments of FIGS. 1*a,* 1*b*. The coupling means 705*a,* 705*b* may also be formed, either alone or in combination with superconducting material with the normal conductor plate denoted 103 in FIGS. 1*a* and 1*b* (not shown in FIGS. 7*a,* 7*b*). Moreover thin buffer layers between the superconducting films and the dielectric substrate can be provided or not.

In order to provide a multimode device a number of alternating layers of dielectric and superconducting films respectively, advantageously with non-superconducting films on the superconductors, can be arranged on top of each other, having different sizes in agreement with the embodiments of FIGS. 7*a* and 7*b*.

Figure 8A:
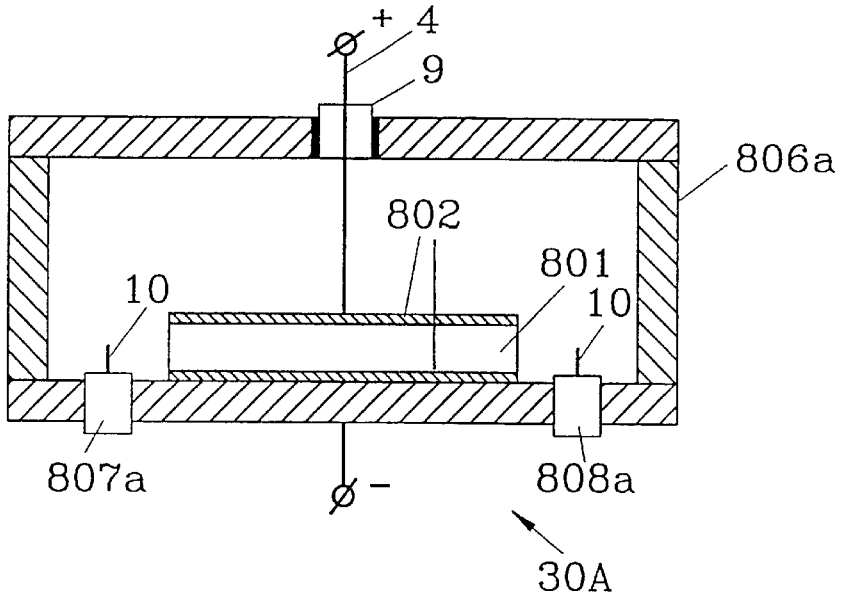
FIG. 8*a* illustrates a cross-sectional view of a parallel plate resonator enclosed in a cavity forming a below cut-off frequency waveguide with probe couplers.

In the following a number of embodiments will be discussed wherein one or more resonators are enclosed in a cavity. Particularly they are enclosed in a below cut-off frequency cavity waveguide. Such a cavity can be made of bulk superconducting material or of a normal metal covered by superconducting films, particularly high temperature superconducting films, on the inside to reduce its microwave losses and to reduce its dimensions. Inductive or capacitive couplers are used to couple the microwave signals in and out of the parallel plate resonator via holes in the walls of the cavity. If a DC voltage is used for the tuning (as referred to above also, temperature tuning can be applied), the tuning voltage is applied by a thin wire 4 through an insulated hole 9 in the wall of the cavity. In FIG. 8*a,* a resonator 30A is illustrated wherein the tuning voltage is applied by the wire 4 through the insulated hole 9 in a wall of the cavity housing 806*a*. The resonator 30A comprises a dielectric substrate 801 which on at least two sides is covered by superconducting films 802. Non-superconducting conducting plates may be arranged thereon as discussed above. Connectors 807*a,* 808*a* are provided for the input and output respectively of microwave signals. Probes 10 are provided for coupling the microwave signals in and out of the resonator. This embodiment thus shows an example on coupling.

Figure 8B:
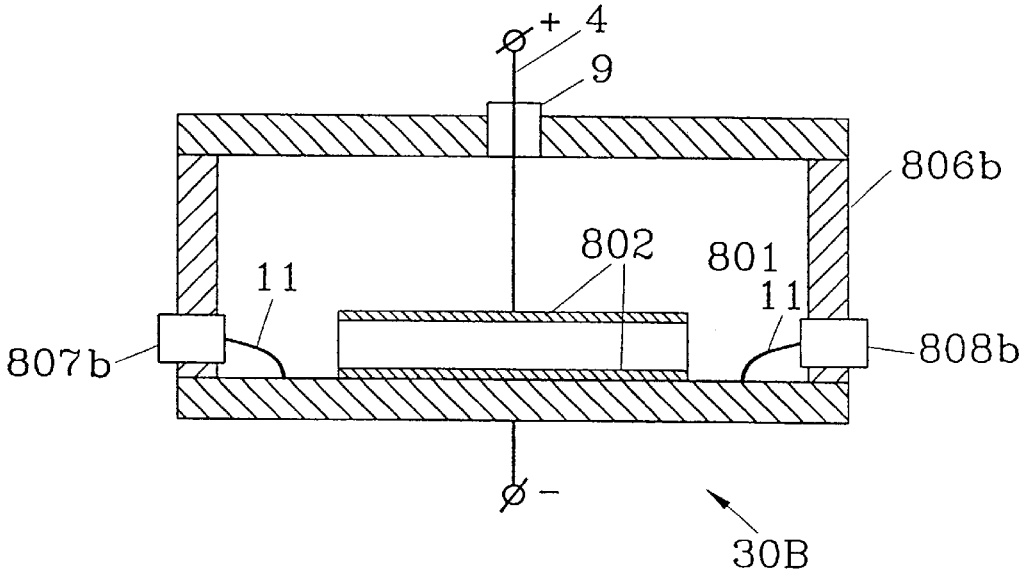
FIG. 8*b* illustrates a cross-sectional view of a parallel plate resonator enclosed in a cavity forming a below cut-off frequency waveguide with loop couplers.

In FIG. 8*b* the resonator 30B is denoted with the same reference numerals as in FIG. 8*a* and will not be described in detail, except to note the cavity housing is denoted 806*b*. In this case the connectors 807*b,* 808*b* are located on the opposite side walls of the cavity 806*b*. Loops 11 are provided for coupling microwave signals in and out of the resonator 30*b* and this is an example on loop coupling. These embodiments show inductive couplings. Below cut-off frequency waveguides made of bulk superconducting material or of normal metal with a high temperature superconducting film provided on the inside of the normal metal are used for enclosing the parallel plate resonator in order to screen out external fields, achieve low losses, facilitate the application of voltage tuning (or any other convenient manner of tuning) and to reduce the size of the resonator.

Figure 9:
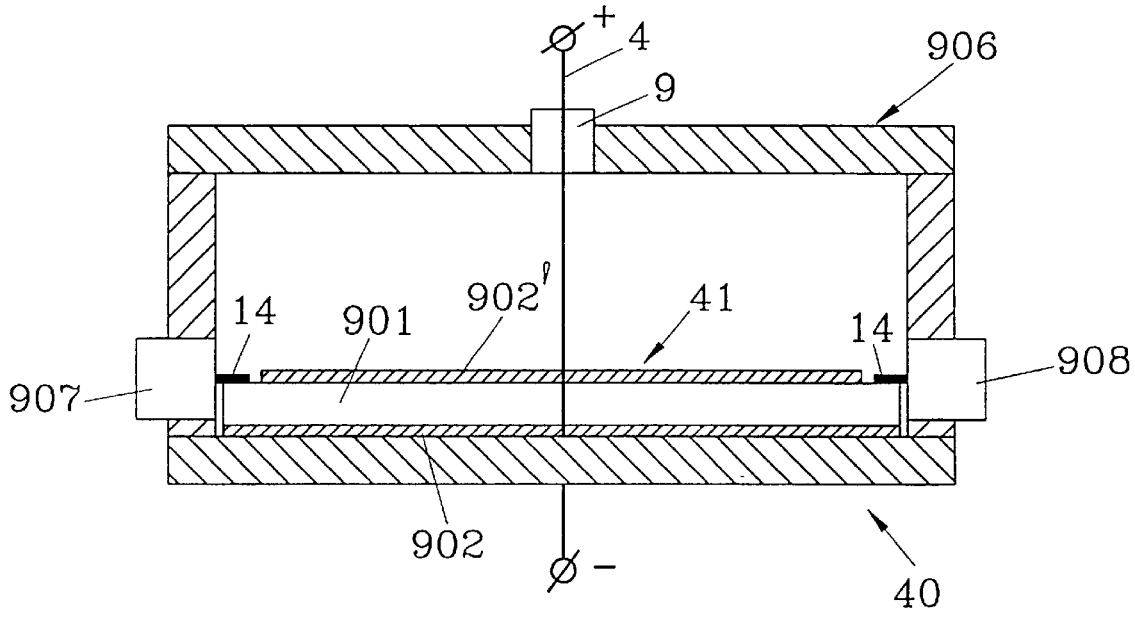
FIG. 9 illustrates a cross-sectional view of a reduced-size cavity with a parallel plate resonator.

FIG. 9 illustrates a device 40 wherein a resonator 41 is enclosed in a superconducting cavity 906 wherein a DC tuning voltage is supplied via the lead 4 for entering the cavity 906 via an insulated hole 9 which for example may comprise a dielectric. The resonator 41 is arranged within the cavity 906 and comprises a dielectric substrate 901 and two sides covered by thin superconducting films 902, 902' wherein the size or the area of the superconducting film 902' (and advantageously conducting plates) is smaller than that of the dielectric substrate 901 in order to provide dual mode operation of the resonator. Connectors 907, 908 are arranged for the input and output of microwave signals respectively and the connectors comprise pins 14 for capacitive coupling of the microwave signals in and out of the resonator.

Figure 10A:
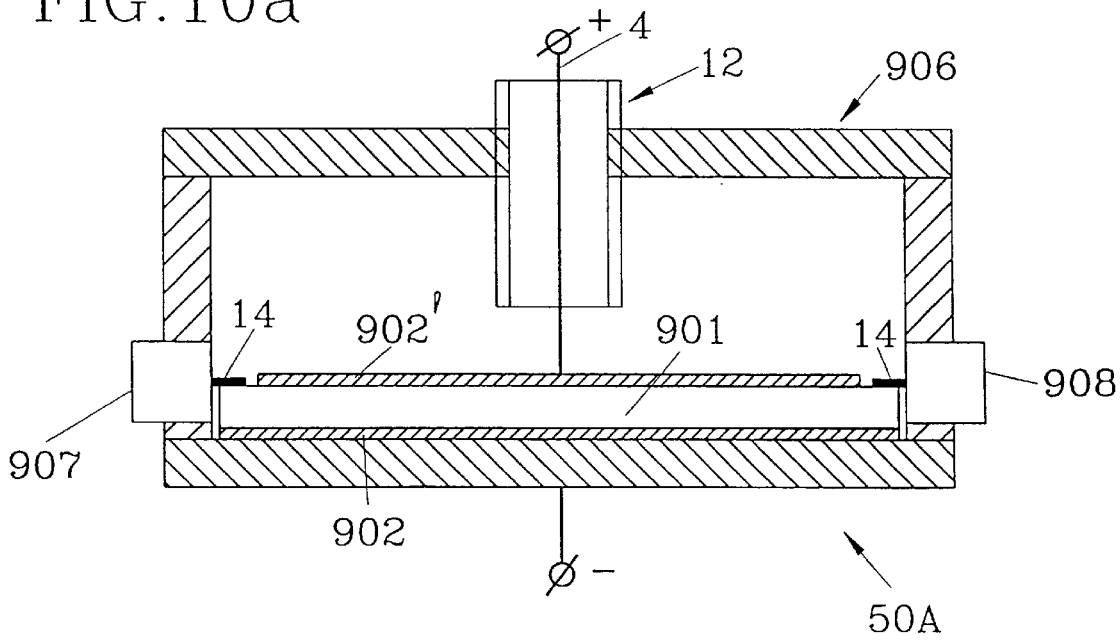
FIG. 10*a* illustrates a cross-sectional view of a parallel plate resonator in a cavity with a frequency adjustment screw.

FIGS. 10*a,* 10*b,* and 10*c* illustrate respective embodiments 50A; 50B; and 50C with elements 901, 902, 902', 907, 908, 4, 14, and 41 functioning similar to that of FIG. 9 but wherein means are provided to enable fine tuning or calibration of the resonant frequency, e.g., in order to compensate for the spread in material and the device parameters. The reference numerals correspond to the ones of FIG. 9. In the devices 50A, 50B of FIGS. 10*a* and 10*b* respectively a dielectric or metal screw 12, 15 is arranged to provide the adjusting of the resonant frequency. In FIG. 10*a* the screw 12, which is moveable, is arranged at the top of the cavity 906 whereas in FIG. 10*b* insulating hole 9 is included at the top and the screw 15 is arranged at the bottom of the cavity 906'. In FIG. 10*c* insulating hole 9 is included at the top of cavity 906" and the resonant frequency is thermally adjustable via a thermal adjusting means at the bottom of cavity 906". The thermal adjusting means here comprises an electrical heating spiral 13. Other appropriate heating means can of course be used and they can be arranged in a different manner etc., FIG. 10*c* merely being an example of how the thermal adjusting means 13 can be arranged. Of course also the screws of FIGS. 10*a* and 10*b* can be arranged in other ways and it does not have to be screws but also other appropriate means can be used and they can be arranged In a number of different ways. In an alternate embodiment (not shown) one of the cavity walls or portion of a wall, or a separate wall, is movable to enable fine tuning or calibration.

Figure 10B:
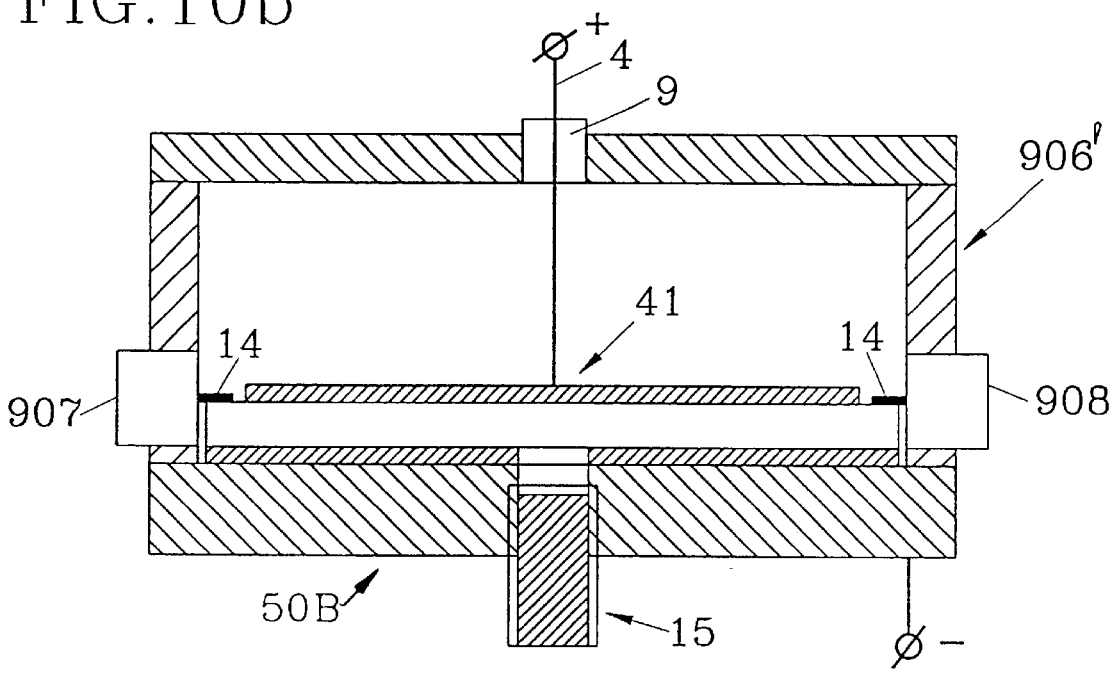
FIG. 10*b* illustrates an embodiment similar to that of FIG. 10*a* but with a differently located adjustment screw.
Figure 10C:
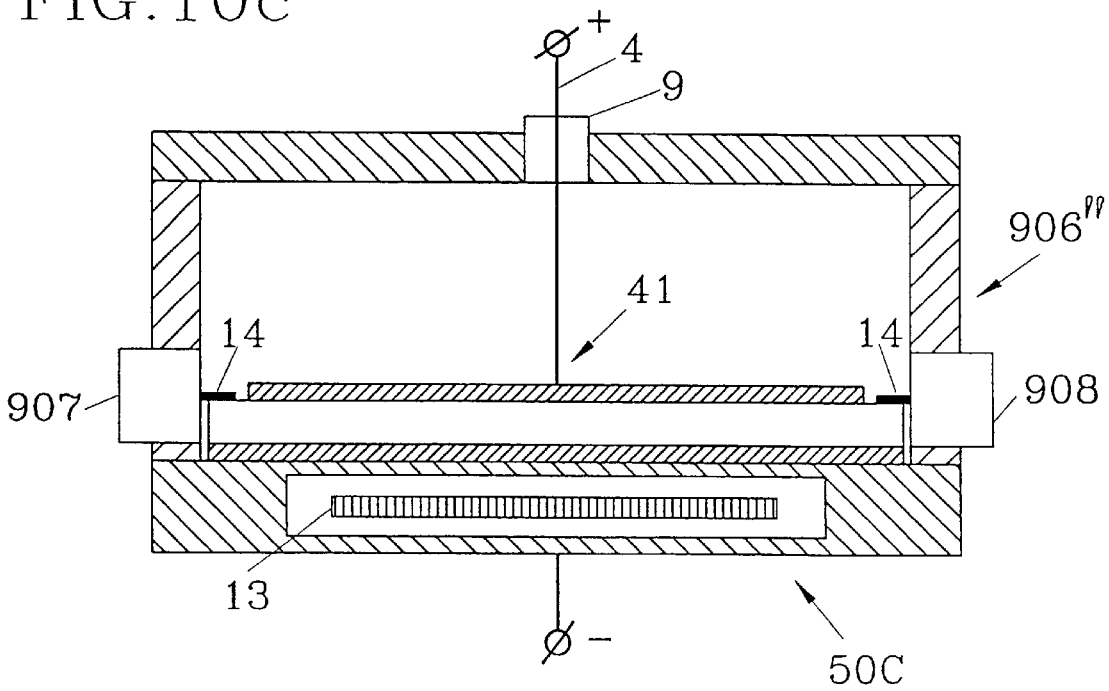
FIG. 10*c* illustrates an embodiment similar to that of FIGS. 10*a* and 10*b* but wherein the frequency adjusting means comprises an electrical heater.

However, via the screw 12 of FIG. 10*a* fine tuning of the resonant frequency is possible whereas via the screw 15 of FIG. 10*b* larger mechanical adjustments of the resonator cavity to achieve for example a change of its center frequency, a channel reconfiguration etc. can be obtained.

Figure 11A:
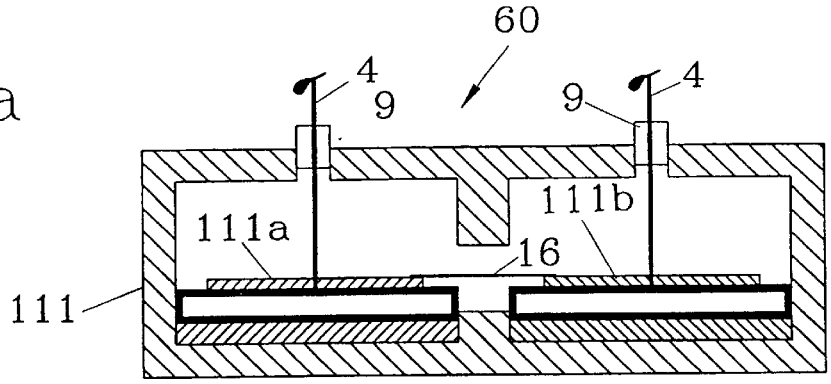
FIG. 11*a* illustrates a cross sectional side view of a four-pole electrically tunable adjustable filter in a superconducting cavity housing.
Figure 11B:
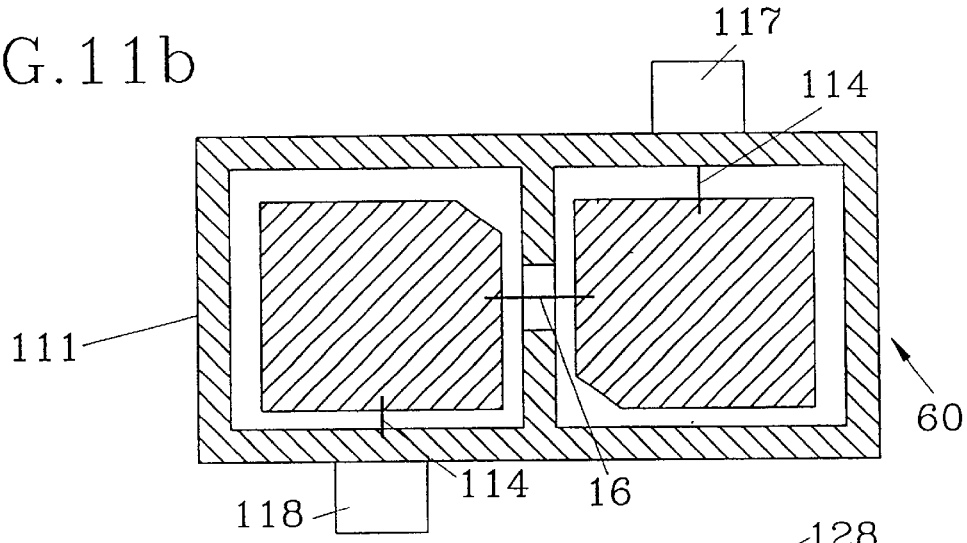
FIG. 11*b* illustrates a top view of the filter of FIG. 11*a* and FIG. 12 illustrates a cross sectional view of a three-pole electrically tunable filter with coupled circular parallel plate resonators.

FIGS. 11*a,* 11*b* and 12 illustrate embodiments with coupling between dual mode resonators forming small size tunable low loss passband filters. FIG. 11*a* shows a cross sectional side view of a four-pole electrically tunable and adjustable filter 60, in a superconducting cavity housing forming a below cutoff frequency waveguide and FIG. 11*b* shows a top view of the four-pole filter 60 of FIG. 11*a*. Two dual mode resonators 111*a*, 111*b* are arranged in a superconducting cavity 111. The dual mode resonators may e.g. take the form of the resonators as illustrated in FIGS. 7*a*, 7*b*. A DC bias voltage is supplied via the leads 4, as in the foregoing described embodiments via insulated holes 9 in the cavity. Connectors 117, 118 (see FIG. 11*b*) are provided for the input and output of microwave signals and the connectors are provided with pins 114 (see FIG. 11*b*)for capacitive coupling of the microwave signals. The two resonators 111*a*, 111*b* are coupled via a coupling pin 16 via an opening in an internal cavity wall.

Figure 12:
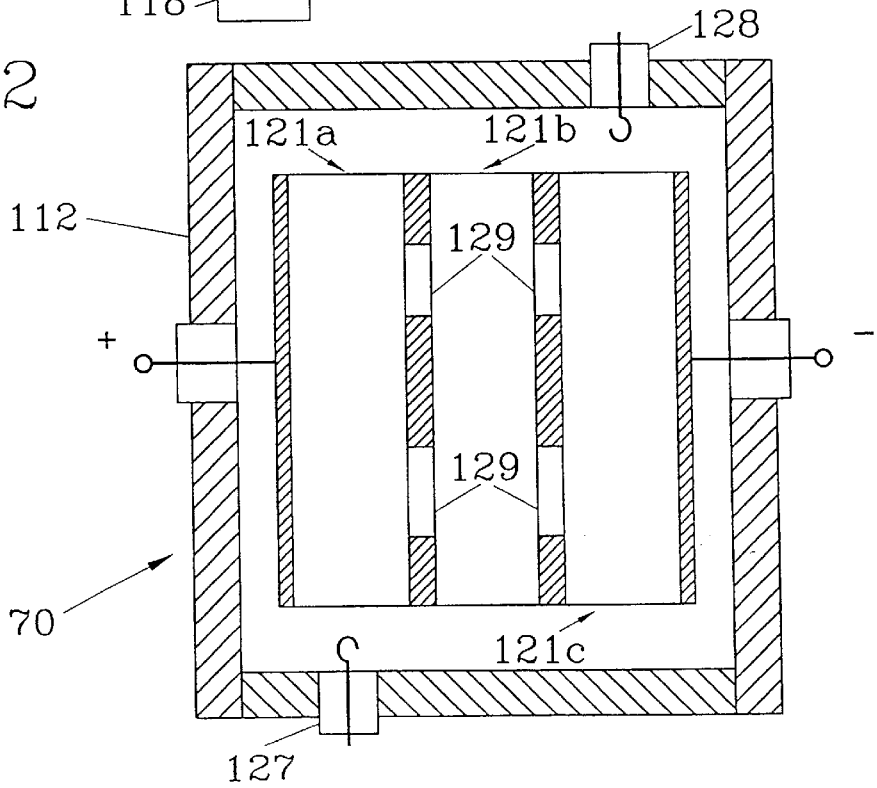

FIG. 12 is a cross-sectional view of an electrically tunable three-pole filter 70 with coupled circular parallel plate resonators in a superconducting cavity 112. In this embodiment two loop couplers 127, 128 are illustrated for coupling microwave signals in and out of the resonators. Coupling between the three circular resonators 121*a*, 121*b*, 121*c* is provided via coupling slots 129.

Of course the principle of the invention can be applied to many other devices, merely a few having been shown for illustrative purposes. Moreover a number of different materials can be used and though for each embodiment merely one way of tuning has been explicitly shown, it is apparent that voltage tuning, or temperature tuning can be used in any embodiment. Also the shapes of the resonators or the superconducting films, as well as the non-superconducting films, and the dielectric can be arbitrarily chosen and moreover also multimode devices can be formed in any desired manner.

What is claimed is:

1. Tunable microwave device comprising a first dielectric substrate including a dielectric material having a variable dielectric constant and a non-linear dielectric single crystal bulk material;

a first superconducting film and a second superconducting film directly disposed on opposing surfaces of the first dielectric substrate such that a parallel plate resonator is provided, wherein the first dielectric substrate comprises a resonant disk having a cylindrical or rectangular shape, and a respective conducting layer is arranged on each of the first and second superconducting films on a side of each of the respective first and second superconducting films that is opposite the corresponding surface of the first dielectric substrate.

2. Device according to claim 1, wherein the first and second superconducting films comprise a high temperature superconducting (HTS) material.

3. Device according to claim 2, wherein the first dielectric material has low dielectric losses and high dielectric constants at cryogenic temperatures.

4. Device of claim 1, wherein the second superconducting film has an area at least slightly smaller than a corresponding area of the dielectric substrate on which the second superconducting films is arranged to provide coupling between degenerate modes resulting in a dual mode operation resonator.

5. Device according to claim 1, wherein a thin buffer layer is arranged between superconducting film and the first dielectric substrate.

6. Device according to claim 1, wherein the respective conducting layers comprise non-superconducting metal.

7. Device according to claim 1, wherein a thickness of at least one of the first and second superconducting films exceeds the London penetration depth ($\lambda_L$).

8. Device according to claim 1, wherein the device is electrically tunable.

9. Device according to claim 8, wherein the dielectric constant of the dielectric material is varied by application of a voltage to the first and second superconducting films.

10. Device according to claim 1, wherein the device is thermally tunable meaning that the dielectric constant is changed when the temperature is changed.

11. Device according to claim 1, wherein a thin buffer layer is arranged between the second superconducting film and the dielectric substrate.

12. Device of claim 1, wherein:

a second dielectric substrate is arranged on a side of the first superconducting film that is opposite the first dielectric substrate, a third dielectric substrate is arranged on a side of the second superconducting film that is opposite the first dielectric substrate, and the first and second superconducting films are arranged in such a way that coupling is provided between first, second, and third dielectric substrates to provide a multimode resonator.

13. Device of claim 1, wherein the first superconducting film has an area at least slightly smaller than a corresponding area of the dielectric substrate on which the first superconducting films is arranged to provide coupling between degenerate modes resulting in a dual mode operation resonator.

14. Device according to claim 13, further comprising means for controlling the coupling between at least two of the degenerate modes associated with the first and second superconducting films thereby realizing at least a two-pole tunable passband filter.

15. Device of claim 1, wherein the device is enclosed in a cavity.

16. Device according to claim 15, wherein the cavity is a below cut-off frequency waveguide.

17. Device according to claim 15, wherein the cavity is superconducting comprising either bulk superconducting material or non-superconducting material covered by a superconducting film.

18. Device according to claim 17, wherein coupling means are provided for coupling micro-wave signals into or out of the cavity.

19. Device according to claim 17, further comprising means for fine-tuning or calibrating the resonant frequency of the resonator.

20. Device according to claim 19, wherein the second means comprises at least one of a mechanically adjustable arrangement and a thermal adjusting means, within the cavity.

21. Device according to claim 15, wherein the cavity comprises two sub-cavities either in the form of separate cavities or a divided cavity, each subcavity with at least one resonator, and the resonators are connected to each other via interconnecting means thereby defining a multiple filter.

22. Device according to claim 1, wherein the dielectric substrate comprises SrTiO3 and at least one of the first and second superconducting films comprises YBCO.

23. Device according to claim 1, wherein the shape and size of the dielectric substrate, the first superconducting film, and the second superconducting film are substantially the same.

24. Tunable microwave resonator comprising a dielectric substrate and a first superconducting film arranged on a first surface of the dielectric substrate and a second superconducting film arranged on a second surface of the dielectric substrate, the second surface of the first substrate being opposite the first surface, first tuning means connecting to one or more of the first superconducting film or the second superconducting film, the dielectric substrate comprising a non-linear bulk material, wherein the first superconducting film, the second superconducting film and the dielectric substrate define a parallel plate resonator and, on those sides of the first and second superconducting films that are opposite to the first substrate, non-superconducting layers are arranged.

25. Tunable microwave resonator according to claim 24 comprising at least two modes associated therewith to realize at least a dual mode resonator.

26. Tunable microwave resonator according to claim 24, wherein second tuning means are provided for fine tuning or adjusting the resonant frequency of the resonator.

27. Tunable microwave filter comprising at least one resonator arranged in a cavity, each of the at least one resonators comprising a dielectric substrate, on which a superconducting film arrangement is provided on at least two surfaces, and first tuning means connecting to at least part of the superconducting arrangement for changing the dielectric constant ($\in$) of the dielectric substrate, wherein:

the superconducting films are directly disposed on the dielectric substrate of each resonator, the at least one resonators comprise a parallel-plate resonator, conducting layers are arranged on respective superconducting films on the sides of the superconducting films opposite to the dielectric substrate, the dielectric substrate is formed by a non-linear bulk material, and coupling means are provided between at least two of the at least one resonators.

28. A tunable microwave device, comprising:

a substrate comprised of a dielectric material having a variable dielectric constant and including a non-linear dielectric single crystal bulk material;

a first superconducting film disposed on a first side of the substrate;

a second superconducting film disposed on a second side of the substrate opposite the first side, such that a parallel plate resonator is provided;

a first conducting layer disposed on the first superconducting film; and a second conducting layer disposed on the second superconducting film, wherein the substrate includes a resonant disk having either a cylindrical or rectangular shape, and the dielectric material has low dielectric losses and high dielectric constants at cryogenic temperatures.

* * * * *